US008927891B2

(12) United States Patent
Garringer et al.

(10) Patent No.: US 8,927,891 B2
(45) Date of Patent: Jan. 6, 2015

(54) MEDIA QUALITY ASSESSMENT SYSTEM AND METHOD

(75) Inventors: John P. Garringer, Suwanee, GA (US); Sean P. Harte, Enfield (IE)

(73) Assignee: NCR Corporation, Duluth, GA (US)

( * ) Notice: Subject to any disclaimer, the term of this patent is extended or adjusted under 35 U.S.C. 154(b) by 536 days.

(21) Appl. No.: 12/749,983

(22) Filed: Mar. 30, 2010

(65) Prior Publication Data

US 2011/0127202 A1 Jun. 2, 2011

Related U.S. Application Data

(60) Provisional application No. 61/265,166, filed on Nov. 30, 2009.

(51) Int. Cl.

| | |
|---|---|
| ***B07C 5/34*** | (2006.01) |
| ***G07F 7/06*** | (2006.01) |
| ***G07F 17/00*** | (2006.01) |

(52) U.S. Cl.

CPC ..... *G07F 7/069* (2013.01); *G07F 17/0042* (2013.01)

USPC ..... 209/576; 209/587; 700/236

(58) Field of Classification Search

CPC ..... G01N 21/29; G01N 21/55

USPC ..... 209/576, 587; 700/214, 231, 232, 233, 700/236; 235/381

See application file for complete search history.

(56) References Cited

U.S. PATENT DOCUMENTS

| | | | | |
|---|---|---|---|---|
| 4,839,505 | A * | 6/1989 | Bradt et al. | 235/381 |
| 5,914,495 | A * | 6/1999 | Ishizuka et al. | 250/559.45 |
| 6,262,432 | B1 * | 7/2001 | Brunfeld et al. | 250/559.45 |
| 7,444,296 | B1 * | 10/2008 | Barber et al. | 705/17 |
| 8,018,585 | B2 * | 9/2011 | Hariyama et al. | 356/237.2 |
| 8,095,236 | B2 * | 1/2012 | Rudy et al. | 700/238 |
| 8,208,356 | B2 * | 6/2012 | Ishihara et al. | 369/53.1 |
| 2001/0015415 | A1 * | 8/2001 | Okamoto | 250/559.45 |
| 2002/0046122 | A1 * | 4/2002 | Barber et al. | 705/17 |
| 2004/0264307 | A1 * | 12/2004 | Wilhelmsson | 369/30.1 |
| 2007/0051802 | A1 * | 3/2007 | Barber et al. | 235/383 |
| 2007/0263506 | A1 * | 11/2007 | Gulas et al. | 369/47.53 |
| 2008/0114632 | A1 * | 5/2008 | Partee et al. | 705/7 |
| 2008/0239904 | A1 * | 10/2008 | Yoshida et al. | 369/53.17 |
| 2010/0325001 | A1 * | 12/2010 | Barber et al. | 705/17 |
| 2011/0085430 | A1 * | 4/2011 | Kadowaki et al. | 369/53.34 |
| 2011/0204134 | A1 * | 8/2011 | Crackel et al. | 235/375 |

FOREIGN PATENT DOCUMENTS

| | | | |
|---|---|---|---|
| EP | 0249367 | A2 | 12/1987 |
| EP | 1063640 | A2 | 12/2000 |
| JP | 2006024274 | A * | 1/2006 |
| WO | 0072160 | A1 | 11/2000 |

OTHER PUBLICATIONS

European Search Report for EP Application No. EP10163552, dated Oct. 6, 2010.

* cited by examiner

*Primary Examiner* — Joseph C Rodriguez

(74) *Attorney, Agent, or Firm* — Kevin P. Belote; Joseph P. Merhle

(57) ABSTRACT

A digital versatile disc (DVD) rental kiosk comprises a mechanism whereby the quality of DVDs is assessed on their return to the kiosk following rental. Any DVD that shows signs of damage, or otherwise considered have a poor play-back quality, is placed in a quarantine area and is thereby prevented from being issued to a future customer. A method of assessing the quality of returned DVDs is also disclosed.

21 Claims, 5 Drawing Sheets

MEDIA QUALITY ASSESSMENT SYSTEM AND METHOD

CROSS REFERENCE TO RELATED APPLICATION

The present application claims the benefit of the filing date of Provisional Application Ser. No. 61/265,166, filed Nov. 30, 2009, under the same title.

FIELD OF THE INVENTION

This invention relates to a media quality assessment system and method. More particularly, the invention relates to a media quality assessment system and method for optically read media.

BACKGROUND TO THE INVENTION

The use of self-service terminals (SSTs) in the sale and hiring of physical media such as digital versatile discs (DVDs) is increasing in popularity as customers become more used to the self-service experience. Such DVD sale and rental kiosks bring with them the normal attendant benefits to both retailers and consumers that self-service terminals have brought to other areas, such as reduced queuing times, increased choice and ease of transaction, etc.

However, there are a number of particular issues associated with the sale and hire of DVDs including the return of damaged or poor quality media items to the kiosk. This problem is particularly acute in rental transactions where returned media is prone to reissue to a future customer. If damaged media is reissued to a future customer the customer is likely to have a poor viewing quality of their rented DVD. This leads to the customer having a poor experience of DVD rental kiosk usage, due to their time being wasted in renting and viewing an unwatchable DVD, which may dissuade them from using a DVD rental kiosk in the future, i.e. reduced customer loyalty.

The most prevalent form of damage to DVDs is scratching of the plastic surface of the disc such that the disc cannot be read satisfactorily by the customer's DVD player.

Furthermore, if the rented DVD is particularly severely damaged there is the possibility of the DVD damaging the renters DVD player, with consequential liability issues.

SUMMARY OF THE INVENTION

According to a first aspect of the present invention there is provided a media accepting self-service terminal comprising:

a media acceptance mechanism comprising a quarantine area;

a processor; and the media acceptance mechanism being arranged to receive media from a user and to generate notification data that media has been received therein and to pass the notification data to the processor;

the processor being arranged to instigate a quality assessment routine at the quality assessment module; and the quality assessment module being arranged to assess the quality of the media;

and the processor being arranged to determine whether to instruct the media acceptance mechanism to place the accepted media in the quarantine area based upon the result of the quality assessment of the media.

This arrangement allows an automated self-service terminal based assessment of the quality of returned media to prevent it being reissued to another customer should the user feedback regarding the quality of the media to be negative.

The quality assessment module may comprise a display and a user interface. The processor may be arranged to generate quality assessment screen data in response to receiving the notification data. The display may be arranged to display a screen based upon the quality assessment screen data on the display, wherein the screen contains a user query regarding the quality of the accepted media. The user interface may be arranged to receive a user input data indicative of whether the quality of the accepted media was acceptable to the user. The processor may be arranged to determine whether to instruct the media acceptance mechanism to place the accepted media in a quarantine area based upon the user input data.

The processor may be arranged to instruct the acceptance mechanism to place the accepted media in the quarantine area based upon the user input data. The media acceptance mechanism may be arranged to move the accepted media to the quarantine area upon receipt of the instruction from the processor. The quarantine area may comprise a receptacle arranged such that once media is placed therein said media is prevented from being output from the terminal to a customer.

The quarantine area may comprise a standard returned media acceptor of the terminal. The processor may be arranged to flag said returned acceptor as containing media of an unacceptable quality. The processor may be arranged to prevent the issuance of media from said returned media acceptor to a customer based upon the existence of said flag.

The query regarding the quality of the media may comprise at least one of the following: whether the audio quality was acceptable when the media was played; whether the video quality was acceptable when the media was played; whether there is visible damage to the surface of the media.

The user interface may comprise a touch screen. Alternatively, or additionally, the user interface may comprise function definition keys (FDKs).

This arrangement allows for customer feedback to be used in determining whether a piece of media should be quarantined.

The quality assessment module may comprise a sensor arranged to detect physical defects on the surface of the media.

The quality assessment module may comprise a light source arranged to emit light on to the surface of the media.

The light source may be inclined at a shallow, grazing, incidence with respect to a planar, reflective surface of the media. Typically, grazing incidence is less than 20°.

The sensor may be arranged to collect at least some of the light reflected from the surface of the media. The processor may be arranged to receive a signal from the sensor indicative of the amount of light falling on the sensor.

The sensor may be arranged to collect a specular reflection of light emitted from the light source. The processor may be arranged to determine if the amount of light falling on the sensor is below a threshold value, and to instruct the media acceptance mechanism to place the accepted media in the quarantine area based upon this determination.

The sensor may be arranged to collect an off specular reflection of light emitted from the light source. The processor may be arranged to determine if the amount of light falling on the sensor is above a threshold value, and to instruct the media acceptance mechanism to place the accepted media in the quarantine area based upon this determination.

The quality assessment module may comprise a plurality of sensors each arranged to collect light scattered from the surface of the media at different angles with respect to the direction of propagation of the light emitted from the light source. The processor may be arranged to determine if the amount of light falling on one or more of the plurality of sensors is above a threshold value, and to instruct the media acceptance mechanism to place the accepted media in the quarantine area based upon this determination.

Light is scattered by scratches or other surface features away from a specular reflection, where the angle of reflection of the light is substantially equal to the angle of incidence of the light with respect to a plane normal to the surface of the media. Hence, measuring the amount of light reflected away from the surface of the media gives an indication of surface damage.

The quality assessment module may comprise a scanning mechanism, such that the light source-sensor combination is arranged to sample more than one point on the surface of the media. The scanning mechanism may comprise a motor arranged to drive the media. Typically, the motor is arranged to rotate the media. The scanning mechanism may comprise a drive arranged to translate the light-source sensor combination radially over the media.

The processor may be arranged to determine whether the media is an acceptable quality from the output of the sensor at more than one point on the surface of the media.

The light source-sensor combination may comprise a sensor arranged to collect light reflected in a specular direction. The light source-sensor combination may comprise one or more sensors arranged to collect light reflected in an off specular direction.

Scanning the media past the light source-sensor combination allows more of the surface of the media to be sample than just measuring at a single point on the surface of the media, and thereby increases the likelihood of finding a defect likely to reduce playback quality.

The light source may be a laser. The light source may be a light emitting diode (LED). The light source may be an LED laser.

The media may comprise a digital versatile disc (DVD). The self-service terminal may comprise one of the following: a DVD rental kiosk; a DVD sale kiosk.

According to a second aspect of the present application there is provided a method of assessing the suitability of media received at a self-service terminal comprises the steps of:

i) receiving media from a user at the media acceptance mechanism and to generate notification data that media has been received at a media acceptance mechanism;
ii) passing the notification data to a processor;
iii) instigating a quality assessment routine at a quality assessment module in response to the notification being received at the processor;
iv) assessing the quality of the media at the quality assessment module; and
v) determining whether to instruct the media acceptance mechanism to place the accepted media in a quarantine area based upon the result of the quality assessment of the media.

The method may comprise generating quality assessment screen data at the processor in response to receiving the notification data. The method may comprise displaying a screen based upon the quality assessment screen data on a display, wherein the screen contains a user query regarding the quality of the accepted media. The method may comprise receiving a user input data indicative of whether the quality of the accepted media was acceptable to the user at a user interface. The method may comprise determining, at the processor, whether to instruct the media acceptance mechanism to place the accepted media in a quarantine area based upon the user input data. The query regarding the quality of the media may comprise at least one of the following: whether the audio quality was acceptable when the media was played; whether the video quality was acceptable when the media was played; whether there is visible damage to the surface of the media.

The method may comprise detecting physical defects on the surface of the media with a sensor.

The method may comprise emitting light on to the surface of the media from a light source.

The method may comprise collecting at least some of the light reflected from the surface of the media at the sensor. The method may comprise receiving a signal from the sensor indicative of the amount of light falling on the sensor at the processor.

The method may comprise collecting a specular reflection of light emitted from the light source at the sensor. The method may comprise determining if the amount of light falling on the sensor is below a threshold value at the processor, and instructing the media acceptance mechanism to place the accepted media in the quarantine area based upon this determination.

The method may comprise collect an off specular reflection of light emitted from the light source at the sensor. The method may comprise determining if the amount of light falling on the sensor is above a threshold value at the processor, and to instruct the media acceptance mechanism to place the accepted media in the quarantine area based upon this determination.

The method may comprise collecting light scattered from the surface of the media at different angles with respect to the direction of propagation of the light emitted from the light source at a plurality of sensors. The method may comprise determining if the amount of light falling on one or more of the plurality of sensors is above a threshold value at the processor, and to instruct the media acceptance mechanism to place the accepted media in the quarantine area based upon this determination.

The method may comprise driving the media. Typically, method may comprise rotating the media. The method may comprise translating the light-source sensor combination radially over the media.

The method may comprise determining whether the media is an acceptable quality from the output of the sensor at more than one point on the surface of the media, at the processor.

The method may comprise collecting light reflected in a specular direction at the sensor. The light source-sensor combination may comprise one or more sensors arranged to collect light reflected in an off specular direction.

The media may comprise a digital versatile disc (DVD). The self-service terminal may comprise one of the following: a DVD rental kiosk; a DVD sale kiosk.

According to a third aspect of the present invention there is provided software, which when executed on a processor, causes the processor to act as the processor of the first aspect of the present invention.

According to a fourth aspect of the present invention there is provided a method of reducing the issuance of damaged media to a customer comprising assessing the quality of media received from a user according to the second aspect of the present invention and preventing reissuance of the media should the determination of Step (v) of the second aspect of the present invention determine that the media is damaged.

According to a fifth aspect of the present invention there is provided a method of improving customer satisfaction comprising reducing the issuance of damaged media to a customer according to the fourth aspect of the present invention.

DETAILED DESCRIPTION OF THE PREFERRED EMBODIMENTS

Figure 1:
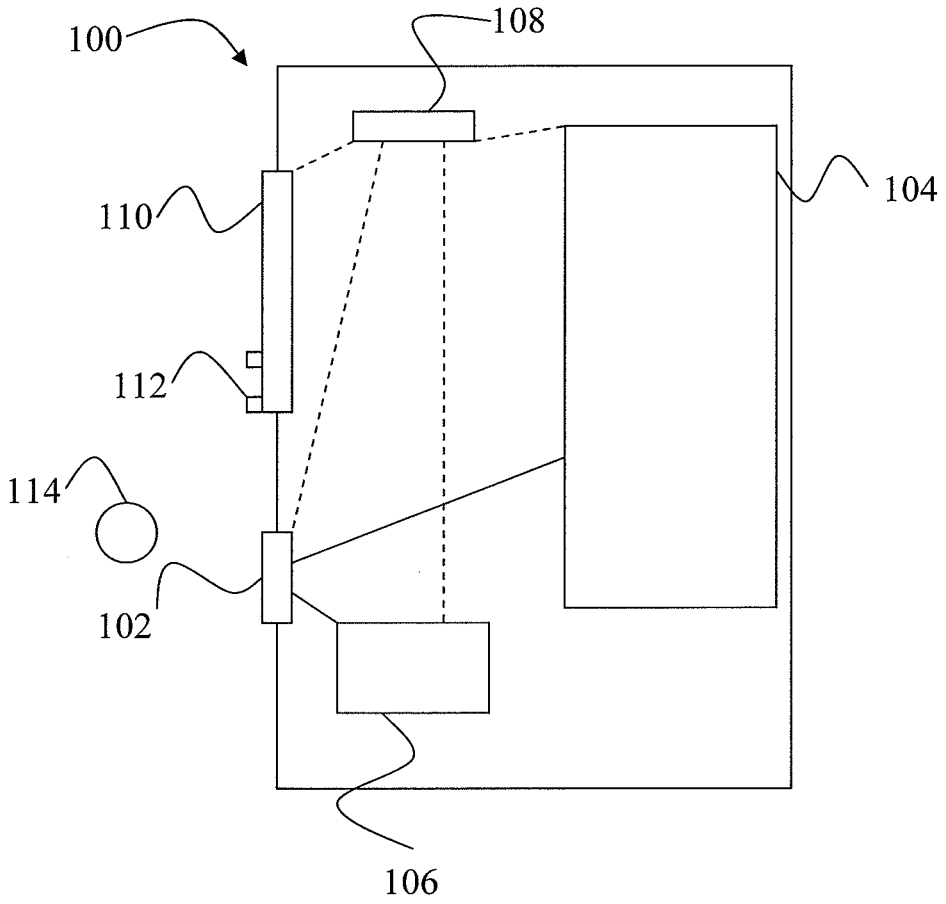
FIG. 1 is a schematic diagram of a first embodiment of a self-service terminal according a first aspect of the present invention.
Figure 2:
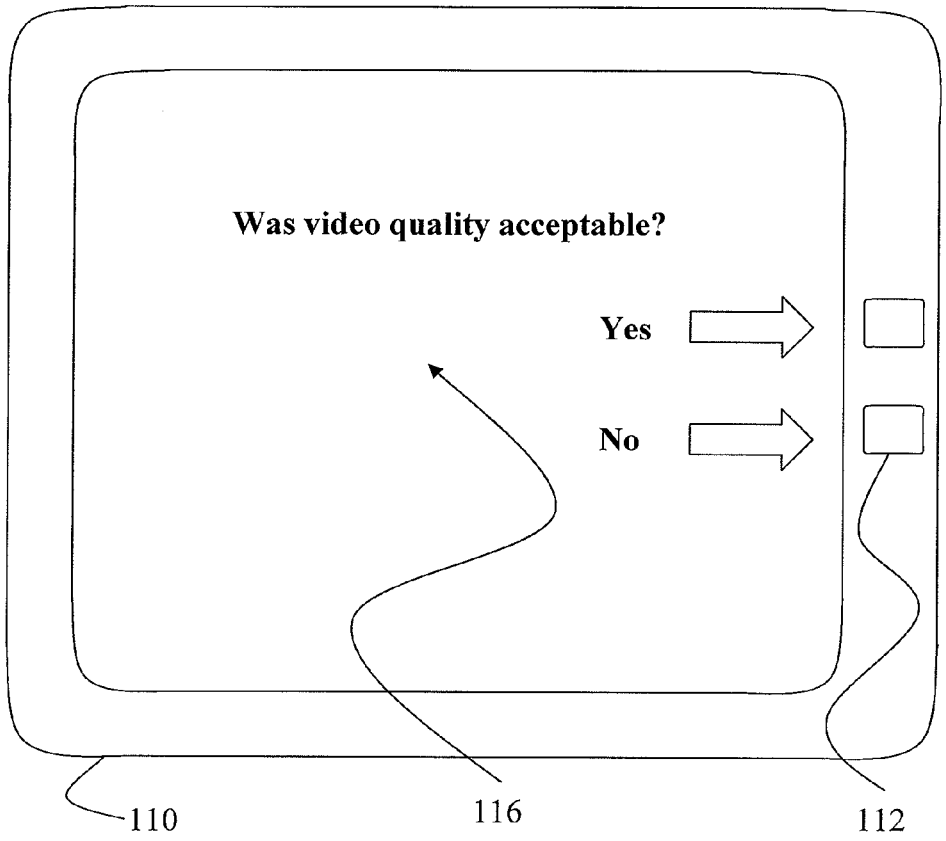
FIG. 2 is a schematic diagram of a quality assessment screen displayed on a display of the self-service terminal of FIG. 1.
Figure 3:
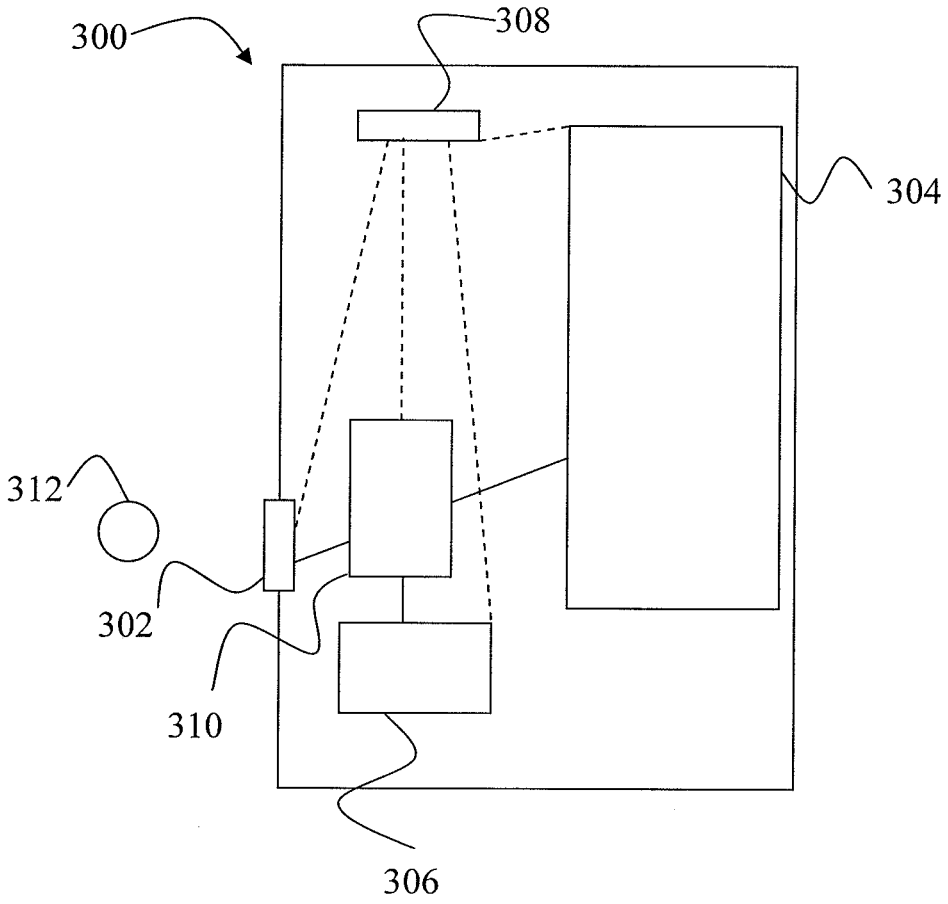
FIG. 3 is a schematic diagram of a second embodiment of a self-service terminal according to the first aspect of the present invention.

Referring now to FIGS. 1 and 2, a self-service DVD rental kiosk 100 comprises a media acceptance mechanism 102, a DVD storage arrangement 104, a quarantine area 106, a processor 108, a display 110 and function definition keys (FDKs) 112.

The media acceptance mechanism 102 receives a previously rented DVD 114 from a customer and generates notification data that DVD 114 has been received. This notification data passes to the processor 108 which generates quality assessment screen data in response to receiving the notification data.

A screen 116 based upon the quality assessment screen data is output on the display 110. The screen 116 contains a query asking the customer for their assessment regarding the quality of DVD 114 that they have just deposited. Typical questions that may be asked in the screen 116 include, but are not limited to: whether the audio quality was acceptable when the DVD 114 was played; whether the video quality was acceptable when the DVD 114 was played; whether there is visible damage to the surface of the media 114.

The customer answers "Yes" or "No" to the question, or questions, asked on the screen 116 using the FDKs 112. The processor 108 receives data based upon the customer's response to the question, or questions, and makes a determination whether or not to instruct the media acceptance mechanism 102 to place the accepted returned DVD 114 in the quarantine area 106 based upon the customer response. For example, the customer may respond to the questions on the screen that the audio quality and video quality of the DVD 114 were acceptable but there was damage to the surface of the DVD 114, in this instance the processor 108 determines that the DVD 114 can be returned to the DVD storage arrangement 104, but updates a database that the DVD 114 may be coming to the end of its rentable life due to surface damage. However, if the customer responds that either, or both, of the audio and video quality were unacceptable the processor 108 will instruct the media acceptance mechanism to place the DVD 114 into the quarantine area 106 irrespective of the customer's assessment of surface damage to the DVD 114. When the DVD 114 is placed in the quarantine area 104 a database of DVD titles available from the kiosk 100 is updated to reflect that the DVD 114 is no longer available for rental.

Typically, the quarantine area 104 comprises a receptacle arranged such that once DVD 114 is placed in it the DVD 114 is prevented from being output from the terminal 100 to a customer, for example by means of a one-way flap. The quarantine area 104 will be accessible to an employee of the kiosk operator, or a service engineer, so that DVDs having been noted as having a poor quality by customers can be removed and examined, and if appropriate reintroduced for future rental if their examination proves them to be of sufficient quality.

It will be appreciated that although described with reference to FDKs 112 the present invention may comprise a user interface in the form of a touch screen, or a combination of FDKs 112 and a touch screen.

Referring now to FIGS. 3 to 7, a DVD rental kiosk 300 comprises a media acceptance mechanism 302, a DVD storage arrangement 304, a quarantine area 306, a processor 308 and a quality assessment module 310.

The media acceptance mechanism 302 receives a previously rented DVD 312 from a customer and generates notification data that DVD 312 has been received. This notification data passes to the processor 308 which then activates the quality assessment module 310, which is arranged to sample the DVD 312 to determine if it is of sufficient quality to be reissued to a future customer. The processor 308 receives data from the assessment module 310 and makes a determination whether or not to instruct the media acceptance mechanism 302 to place the accepted returned DVD 312 in the quarantine area 306 based upon the results obtained from the assessment module 310. Various embodiments and elements of the quality assessment module 310 are described in detail hereinafter with particular reference to FIGS. 4 to 7.

Figure 4:
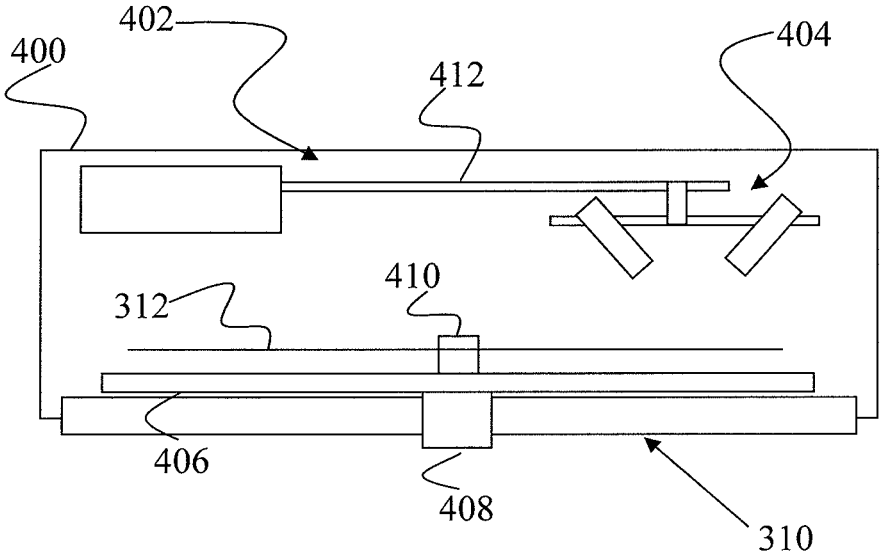
FIG. 4 is a schematic diagram of a quality assessment module of the self-service terminal of FIG. 3.

Referring now to FIG. 4, in particular, the quality assessment module 310 comprises a housing 400 in which a scanning mechanism 402 and a sensing arrangement 404 are located. The scanning mechanism 402 is allows for mounting of the DVD 312 within the quality assessment module 310 such that relative motion between the DVD 312 and the sensing arrangement 404 can be effected. The relative motion between the DVD 312 and sensing arrangement 404 results in more than one are of the DVD 312 being sampled for surface defects and/or scratches.

The scanning mechanism 402 comprises a platen 406, a media drive motor 408 with a spindle 410 that engages the DVD 312 and a drive arm 412 on which the sensing arrangement 404 is mounted. The DVD 312 is rotated by the motor 408 and the sensing arrangement 404 senses a along a track of the surface of the DVD 312 and the drive arm 412 moves the sensing arrangement 404 radially across the surface of the DVD 312 such that a portion, preferably substantially all of the playback area of the DVD 312 is scanned for surface defects and scratches.

This gives a more accurate determination of whether the DVD 312 is of acceptable quality for reissue to a customer than a sample of a single area of the DVD 312.

Figure 5:
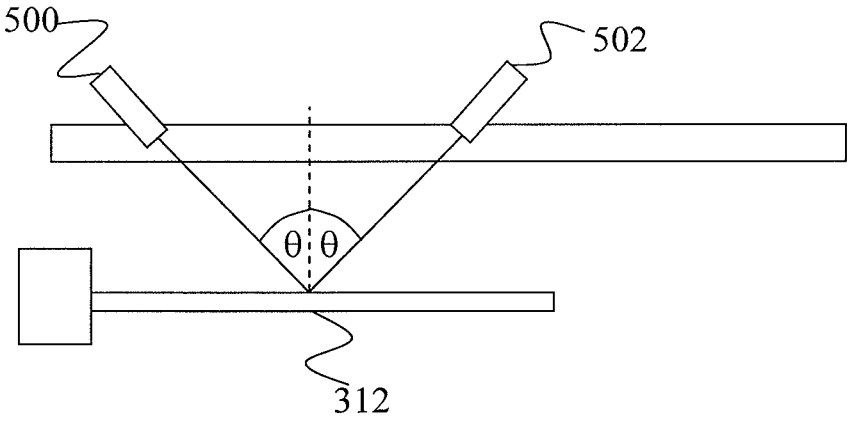
FIG. 5 is a schematic diagram of one embodiment of light source—sensor arrangement of the quality assessment module of FIG. 4.

Referring now to FIG. 5, in particular, in one embodiment, the sensing arrangement 404 comprises a light source 500 and a sensor 502. The light emitted from the light source 500 strikes the DVD 312 and is reflected from the DVD's surface. The sensor 502 is arranged such that it collects light emitted from the light source 500 that is reflected in a specular direction. The output of the sensor 502 is sent to the processor 308.

Scratches and other surface defects cause light to be scattered off specular, leading to a reduction in intensity of the specular reflection. Accordingly, a threshold level of specularly reflected light is set, below which the surface of the DVD 312 is considered too damaged to give a reliable quality of playback. Should the output of the sensor 502, when analyzed by the processor 308, be found to fall below the threshold level the processor 308 instructs the media acceptance mechanism 302 to place the returned DVD 312 in the quarantine area.

Figure 6:
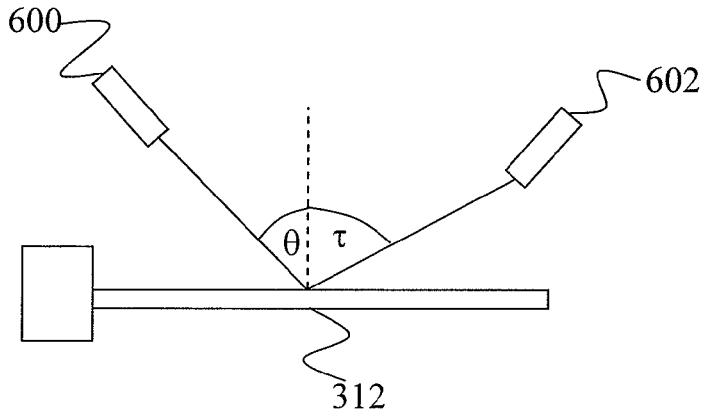
FIG. 6 is a schematic diagram of another embodiment of a light source—sensor arrangement of the quality assessment module of FIG. 4.

Referring now to FIG. 6, in particular, in one embodiment, the sensing arrangement 404 comprises a light source 600 and a sensor 602. The light emitted from the light source 600 strikes the DVD 312 and is reflected from the DVD's surface. The sensor 602 is arranged such that it collects light emitted from the light source 600 that is reflected in an off-specular direction. The output of the sensor 602 is sent to the processor 308. Scratches and other surface defects cause light to be scattered off-specular, leading to an increase in the intensity of the off-specular reflection. Accordingly, a threshold level of light which is reflected off-specular is set, above which the surface of the DVD 312 is considered too damaged to give a reliable quality of playback. Should the output of the sensor 602, when analyzed by the processor 308, be found to fall below the threshold level the processor 308 instructs the media acceptance mechanism 302 to place the returned DVD 312 in the quarantine area.

It will be appreciated that although shown as a single sensor, which may be annular, the sensor 602 can be made of a plurality of individual sensors located at any suitable off-specular angle.

It will be further appreciated that the embodiments shown in FIGS. 5 and 6 can be combined to yield a sensor arrangement which comprises both specular and off-specular sensors. The determination of whether the DVD 312 meets a quality threshold for viewing by future customers can be based on a threshold limit of the light intensity measured by either, or both, the specular and off-specular sensor, or a pre-determined ratio of their respective intensities being met.

Figure 7:
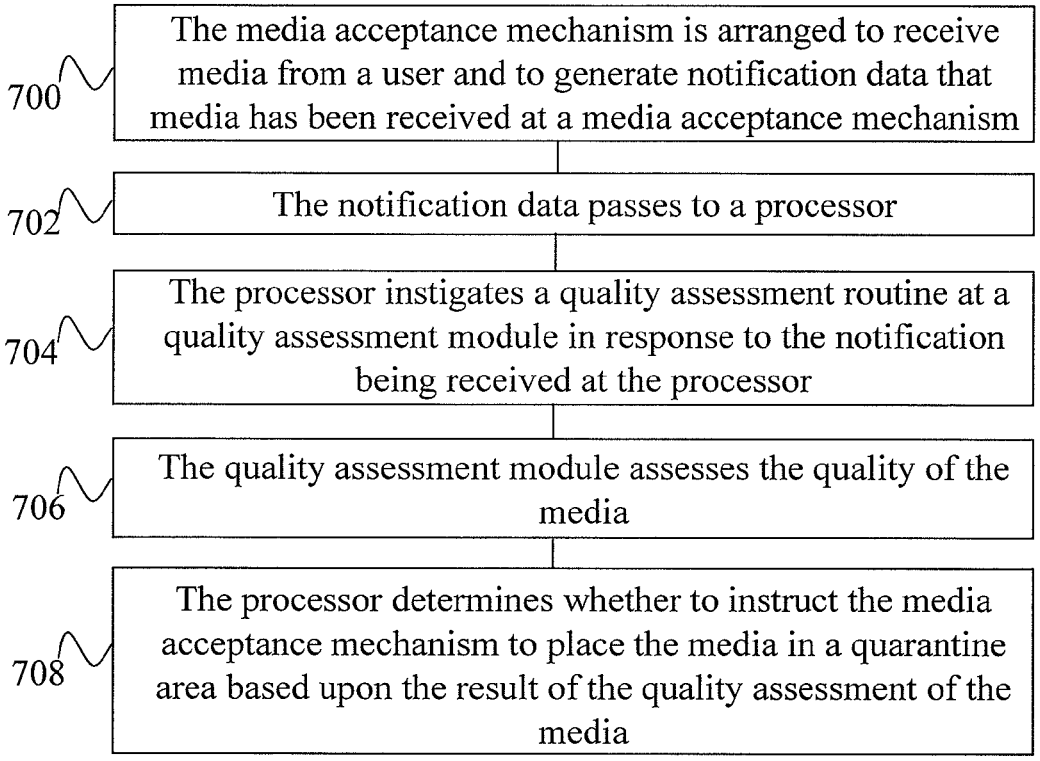
FIG. 7 is a flow diagram showing the steps of a method of assessing the suitability of media received at a self-service terminal for reissue to a future customer.

Referring now to FIG. 7, a method of assessing the suitability of a DVD received at a self-service terminal comprises the media acceptance mechanism being arranged to receive the DVD from a user and to generate notification data that media has been received at a media acceptance mechanism (Step 700). The notification data passes to a processor (Step 702). The processor instigates a quality assessment routine at a quality assessment module in response to the notification being received at the processor (Step 704). The quality assessment module assesses the quality of the DVD (Step 706). The processor determines whether to instruct the media acceptance mechanism to place the DVD in a quarantine area based upon the result of the quality assessment of the DVD (Step 708).

It will be appreciated that, in all embodiments of the invention described hereinbefore, although described with reference to the quarantine area being a separate physical region of the terminal from that where the media is stored for issuance to a customer, the quarantine area can be a standard returned media acceptor, for example a slot for receiving a DVD, of the terminal from which the media can be reissued to the customer, if the returned media is of an acceptable quality. In such an instance, the processor is arranged to generate a flag indicating that said returned acceptor contains media of an unacceptable quality for issuance to a customer, if this is the case, and is arranged to prevent the issuance of media from said returned media acceptor to a customer based upon the existence of said flag.

It will also be appreciated that the steps of the methods described herein may be carried out in any suitable order, or simultaneously where appropriate. The methods described herein may be performed by software in machine readable form on a tangible storage medium or as a propagating signal.

As described herein the DVD kiosk comprises one or more peripheral devices each of which is operable to perform at least one specific function. Typically, the peripheral device implements its function either in response to a customer action and/or a command received from a PC core (which is also a peripheral device) of the DVD kiosk. Non-limiting examples of peripheral devices include: display, media dispense/acceptance mechanism, rear operator panel, encrypting keypad, PC core etc.

Typically, each peripheral device comprises a processor to enable the peripheral device to perform its function, and a communications facility to enable the peripheral device to communicate with the controller, but in some instances this may not be essential.

Each peripheral device comprises one or more components that contribute to the execution of the peripheral device's respective function. Typically, each component comprises a replaceable part within the module. Non-limiting examples of components include: for the display module, a display panel, a display panel housing, and the like.

Each component comprises one or more parts configured to enable the device to contribute to the execution of the peripheral device's function.

It will be appreciated that although described with reference to a DVD rental kiosk the present invention is applicable to any suitable SST or network of SSTs. a video, DVD, multi-media, mpeg3 etc sales/rental kiosk, a lottery kiosk, a postal services machine, a check-in and/or check-out terminal such as those used in the retail, hotel, car rental, gaming, healthcare, and airline industries, or the like.

Various modifications may be made to the above described embodiments without departing from the spirit and the scope of the invention.

The invention claimed is:

1. A media accepting self-service terminal comprising:

a media acceptance mechanism comprising a quarantine area;

a processor; and the media acceptance mechanism being arranged to receive media from a user and to generate notification data that media has been received therein and to pass the notification data to the processor;

the processor being arranged to instigate a quality assessment routine at a quality assessment module; the quality assessment routine comprising directly sensing an amount of specular light reflected off the surface of the media, the specular light scattered from a surface of the media at different angles with respect to a direction of propagation of light emitted from a light source; and the quality assessment module being arranged to assess the quality of the media based at least in part on the amount of specular light sensed; and the processor being arranged to determine whether to instruct the media acceptance mechanism to place the accepted media in the quarantine area based upon the result of the quality assessment of the media, and wherein the quality assessment module arranged to query the user with yes and no questions for answering as to whether video quality for the media was acceptable to the user when played by the user and whether there was visible damage to the media detectible to the user.

2. The terminal of claim 1 wherein, the quality assessment module comprises a display and a user interface.

3. The terminal of claim 2 wherein, the processor is arranged to generate quality assessment screen data in response to receiving the notification data.

4. The terminal of claim 3 wherein, the display is arranged to display a screen based upon the quality assessment screen data on the display, wherein the screen contains a user query regarding the quality of the accepted media.

5. The terminal of claim 2 wherein, the user interface is arranged to receive a user input data indicative of whether the quality of the accepted media was acceptable to the user.

6. The terminal of claim 5 wherein, the processor is arranged to determine whether to instruct the media acceptance mechanism to place the accepted media in a quarantine area based upon the user input data.

7. The terminal of claim 6, wherein the processor is arranged to instruct the acceptance mechanism to place the accepted media in the quarantine area based upon the user input data and the media acceptance mechanism is arranged to move the accepted media to the quarantine area upon receipt of the instruction from the processor.

8. The terminal of claim 1 wherein, the quality assessment module comprises a sensor arranged to directly sense the amount of specular light reflected off the surface of the media and the light source arranged to emit light on to the surface of the media.

9. The terminal of claim 8 wherein the processor is arranged to receive a signal from the sensor indicative of the amount of specular light falling on the sensor.

10. The terminal of claim 9 wherein, the sensor is arranged to collect a specular reflection of light emitted from the light source and the processor is arranged to determine if the amount of light falling on the sensor is below a threshold value, and to instruct the media acceptance mechanism to place the accepted media in the quarantine area based upon this determination.

11. The terminal of claim 9 wherein, the quality assessment module comprises a scanning mechanism, such that the light source-sensor combination is arranged to sample more than one point on the surface of the media.

12. The terminal of claim 11 wherein, the scanning mechanism comprises a motor arranged to drive the media.

13. The terminal of claim 11 wherein, the scanning mechanism comprises a drive arranged to translate the light-source sensor combination radially over the media.

14. The terminal of claim 11 wherein, the processor is arranged to determine whether the media is an acceptable quality from the output of the sensor at more than one point on the surface of the media.

15. The terminal of claim 1 wherein, the media comprises a digital versatile disc (DVD).

16. The terminal of claim 1 wherein, the self-service terminal comprises one of the following: a DVD rental kiosk; a DVD sale kiosk.

17. A method of assessing the suitability of media received at a self-service terminal comprising:

receiving media from a user at a media acceptance mechanism and generating notification data that media has been received at a media acceptance mechanism;

passing the notification data to a processor;

instigating a quality assessment routine at a quality assessment module in response to the notification being received at the processor, the quality assessment routine comprising directly sensing an amount of specular light reflected off the surface of the media, the specular light scattered from the surface of the media at different angles with respect to a direction of propagation of light emitted from the light source;

assessing the quality of the media at the quality assessment module based at least in part on the amount of specular light sensed and user provided input as to whether video quality for the media was acceptable to the user when played by the user and whether there was visible damage to the media detectible to the user, the user provided input provided as yes and no questions for answering by the user; and determining whether to instruct the media acceptance mechanism to place the accepted media in a quarantine area based upon the result of the quality assessment of the media.

18. The method of claim 17 further comprising:

generating quality assessment screen data at the processor in response to receiving the notification data;

displaying a screen based upon the quality assessment screen data on a display, wherein the screen contains a user query regarding the quality of the accepted media;

receiving a user input data indicative of whether the quality of the accepted media was acceptable to the user at a user interface;

determining, at the processor, whether to instruct the media acceptance mechanism to place the accepted media in a quarantine area based upon the user input data.

19. The method of claim 17 wherein sensing an amount of specular light reflected off the surface of the media further comprises emitting light on to the surface of the media from a light source; and collecting the specular light directly reflected from the surface of the media at a sensor; the method further comprising:

receiving at the processor a signal from the sensor indicative of the amount of light falling on the sensor;

determining at the processor if the amount of light falling on the sensor meets a threshold value; and instructing the media acceptance mechanism to place the accepted media in the quarantine area based upon this determination.

20. The method of claim 19, wherein the self-service terminal comprises one of the following: a DVD rental kiosk; a DVD sale kiosk.

21. The terminal of claim 1, wherein the angle of reflection of the specular light is greater than zero.

* * * * *